US008913905B2

(12) United States Patent
Shiomichi et al.

(10) Patent No.: US 8,913,905 B2
(45) Date of Patent: Dec. 16, 2014

(54) IMAGE FORMING APPARATUS THAT DETECTS TRANSITION BETWEEN PATCH IMAGES

(75) Inventors: Hirotaka Shiomichi, Suntou-gun (JP); Ryuhei Shoji, Mishima (JP); Ken Yokoyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 166 days.

(21) Appl. No.: 13/361,128

(22) Filed: Jan. 30, 2012

(65) Prior Publication Data

US 2012/0219306 A1 Aug. 30, 2012

(30) Foreign Application Priority Data

Feb. 28, 2011 (JP) ..... 2011-042654

(51) Int. Cl.
*G03G 15/00* (2006.01)

(52) U.S. Cl.
CPC .. *G03G 15/5062* (2013.01); *G03G 2215/00616* (2013.01)
USPC ..... 399/15

(58) Field of Classification Search
CPC ..... G03G 5/00; G03G 15/00
USPC ..... 347/19; 399/15, 49
See application file for complete search history.

(56) References Cited

U.S. PATENT DOCUMENTS

| | | | | |
|---|---|---|---|---|
| 5,678,132 | A * | 10/1997 | Shiba et al. | 399/59 |
| 7,751,735 | B2 * | 7/2010 | Takahashi | 399/49 |
| 8,447,197 | B2 * | 5/2013 | Yamazaki | 399/49 |
| 2003/0044190 | A1 * | 3/2003 | Nakayama | 399/49 |
| 2003/0085941 | A1 * | 5/2003 | Tezuka et al. | 347/19 |
| 2005/0012948 | A1 * | 1/2005 | Gotoh et al. | 358/1.9 |
| 2005/0260003 | A1 * | 11/2005 | Tezuka | 399/15 |
| 2009/0220260 | A1 * | 9/2009 | Denton et al. | 399/49 |
| 2010/0329710 | A1 * | 12/2010 | Yamazaki | 399/49 |
| 2010/0329711 | A1 * | 12/2010 | Ishikawa et al. | 399/49 |
| 2011/0217052 | A1 * | 9/2011 | Usui et al. | 399/15 |
| 2011/0311245 | A1 * | 12/2011 | Inada et al. | 399/31 |
| 2012/0195650 | A1 * | 8/2012 | Ogawa et al. | 399/301 |
| 2012/0219306 | A1 * | 8/2012 | Shiomichi et al. | 399/15 |
| 2012/0328312 | A1 * | 12/2012 | Shoji | 399/49 |
| 2013/0003084 | A1 * | 1/2013 | Hirose | 358/1.2 |
| 2013/0094039 | A1 * | 4/2013 | Takemura | 358/1.9 |
| 2013/0094040 | A1 * | 4/2013 | Tomii | 358/1.9 |
| 2013/0094041 | A1 * | 4/2013 | Takemura | 358/1.9 |
| 2013/0136474 | A1 * | 5/2013 | Itagaki | 399/49 |
| 2013/0156445 | A1 * | 6/2013 | Takemura | 399/15 |
| 2013/0162998 | A1 * | 6/2013 | Furuta | 356/402 |
| 2013/0209116 | A1 * | 8/2013 | Furuya et al. | 399/49 |
| 2013/0222858 | A1 * | 8/2013 | Yokoyama, Ken | 358/2.1 |

FOREIGN PATENT DOCUMENTS

| | | | | |
|---|---|---|---|---|
| JP | 2000-039747 A | | 2/2000 | |
| JP | 02000039747 A | * | 2/2000 | G03G 15/00 |
| JP | 2006-308812 A | | 11/2006 | |

* cited by examiner

*Primary Examiner* — Clayton E LaBalle
*Assistant Examiner* — Kevin Butler
(74) *Attorney, Agent, or Firm* — Fitzpatrick, Cella, Harper & Scinto

(57) ABSTRACT

An image forming apparatus includes a detection unit configured to irradiate a patch image formed on a recording material with light, and detect light intensities at a plurality of wavelengths in the light reflected from the patch image; and a determination unit configured to determine that a patch image for which the detection unit is detecting light intensities has transitioned from a first patch image to a second patch image, wherein the determination unit is further configured to determine that the patch image for which the detection unit is detecting has transitioned, in a case where a light intensity at a wavelength for identification of a patch image to be identified, has varied by an amount greater than a first threshold corresponding to that wavelength for identification.

13 Claims, 15 Drawing Sheets

IMAGE FORMING APPARATUS THAT DETECTS TRANSITION BETWEEN PATCH IMAGES

This application claims benefit of Japanese Application No. 2011-042654, filed Feb. 28, 2011, which is hereby incorporated by reference herein in its entirety.

BACKGROUND OF THE INVENTION

1. Field of the Invention

The present invention relates to image forming apparatuses, and in particular, relates to a technique for identifying patch images that are formed on a recording material for image correction.

2. Description of the Related Art

Improvement in image quality of images output by color image forming apparatuses such as color printers and color copiers has been sought. Density tones and stability thereof in output images are important elements that decide image quality, and thus it is necessary to suppress variation in density due to environmental changes or long-time use in color image forming apparatuses.

For this reason, Japanese Patent Laid-Open Nos. 2000-039747 and 2006-308812 each disclose a configuration in which toner images for detecting density or a color value (hereinafter referred to as "patch images") are formed on a recording material, and the density or the color value of the patch images formed on the recording material are detected, thereby correcting the density or the color value of the toner images. Here, it is desirable to form a large number of patch images in order to improve correction accuracy, and in order to attain this, patch images formed at various densities or in various colors are arranged on a recording material while providing no interval therebetween.

At this time, since no interval is provided between patch images, in Japanese Patent Laid-Open No. 2000-039747, patch images are arranged such that a difference in density between patch images adjacent to each other is greater than or equal to a predetermined value, and the red, green and blue values are detected using an RGB color sensor, thereby identifying each patch image. Note that as a color sensor, a red LED, a green LED and a blue LED are used in Japanese Patent Laid-Open No. 2000-039747, and a combination of a white LED and RGB filters is used in Japanese Patent Laid-Open No. 2006-308812.

In order to realize better color reproducibility in a color image forming apparatus, it is desirable to detect patch images of higher-order colors such as secondary colors and tertiary colors (mixed-color patch images), in addition to single chromatic colors produced by cyan, magenta and yellow. However, when patch images of higher-order colors are considered, conventional techniques may have the problem described below. That is, if a plurality of mixed-color patch images are arranged while providing no interval therebetween, it may be impossible to detect the boundary between patch images adjacent to each other depending on the color relation between the patch images.

For example, it is assumed that two patch images 53 and 54 are adjacent to each other, and that the spectrum of light reflected by each patch image with respect to a white light source is as shown in FIG. 16. Note that in FIG. 16, reference numerals 50, 51 and 52 respectively indicate the spectral transmission curves of red, green and blue (RGB) filters. In the case of FIG. 16, light reflected by the patch images 53 and 54 take substantially the same RGB values. Accordingly, it is difficult to identify patch images adjacent to each other. In other words, identification accuracy is deteriorated.

SUMMARY OF THE INVENTION

The present invention aims to provide an image forming apparatus capable of accurately determining, with respect to patch images adjacent to each other, that the detection target has shifted from a currently detected patch image to the next patch image.

According to one aspect of the present invention, an image forming apparatus includes a storage unit configured to store data of a plurality of patch images; an image forming unit configured to form the plurality of patch images in succession on a recording material, data of the plurality of patch images being stored in the storage unit; a detection unit configured to irradiate a patch image formed on the recording material with light, and detect light intensities at a plurality of wavelengths in the light reflected from the patch image; and a determination unit configured to determine that a patch image for which the detection unit is detecting light intensities has transitioned from a first patch image to a second patch image. The determination unit is further configured to determine that the patch image for which the detection unit is detecting light intensities has transitioned from a first patch image to a second patch image, in a case where a light intensity at a wavelength for identification of a patch image to be identified, the light intensity being detected by the detection unit, has varied by an amount greater than a first threshold corresponding to that wavelength for identification.

Further features of the present invention will become apparent from the following description of exemplary embodiments with reference to the attached drawings.

DESCRIPTION OF THE EMBODIMENTS

Embodiments of the present invention will be described in detail below with reference to attached drawings.

First Embodiment

Figure 1:
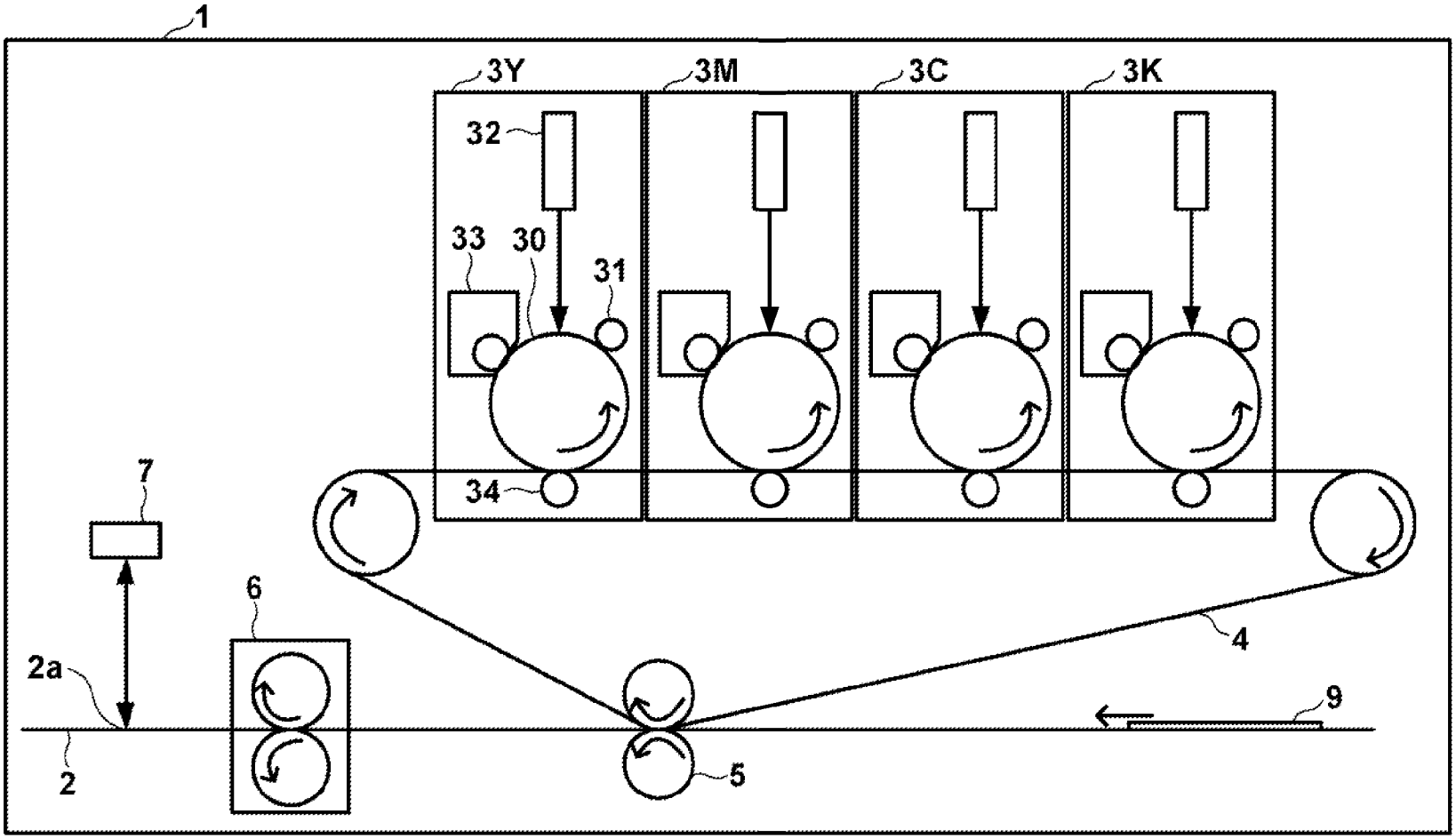
FIG. 1 is a block diagram of an image forming unit of an image forming apparatus of an embodiment.

First, an image forming unit 1 of an image forming apparatus will be described with reference to FIG. 1. A member 3Y for forming a yellow (Y) toner image includes a charging unit 31 that charges the surface of a photosensitive member 30, an exposure unit 32 that forms an electrostatic latent image by exposing the charged surface of the photosensitive member 30. Furthermore, the member 3Y includes a development unit 33 that develops, with toner, the surface of the photosensitive member 30 on which an electrostatic latent image is formed, and a primary transfer member 34 that transfers the toner image on the photosensitive member 30 onto an intermediate transfer member 4. Note that members 3M, 3C and 3K respectively form magenta (M), cyan (C) and black (K) toner images, and since their configuration is the same as that of the member 3Y, a description thereof is omitted here.

Toner images transferred onto the intermediate transfer member 4 are transferred onto a recording material 9 that is conveyed on a sheet conveyance path 2 by a secondary transfer member 5. The toner images transferred onto the recording material 9 are fixed by a fixing unit 6. The image forming unit 1 includes a color sensor 7 that detects the light intensity at each wavelength of a fixed patch image formed on the recording material 9 at a detection position 2*a* on the sheet conveyance path 2.

Figure 2:
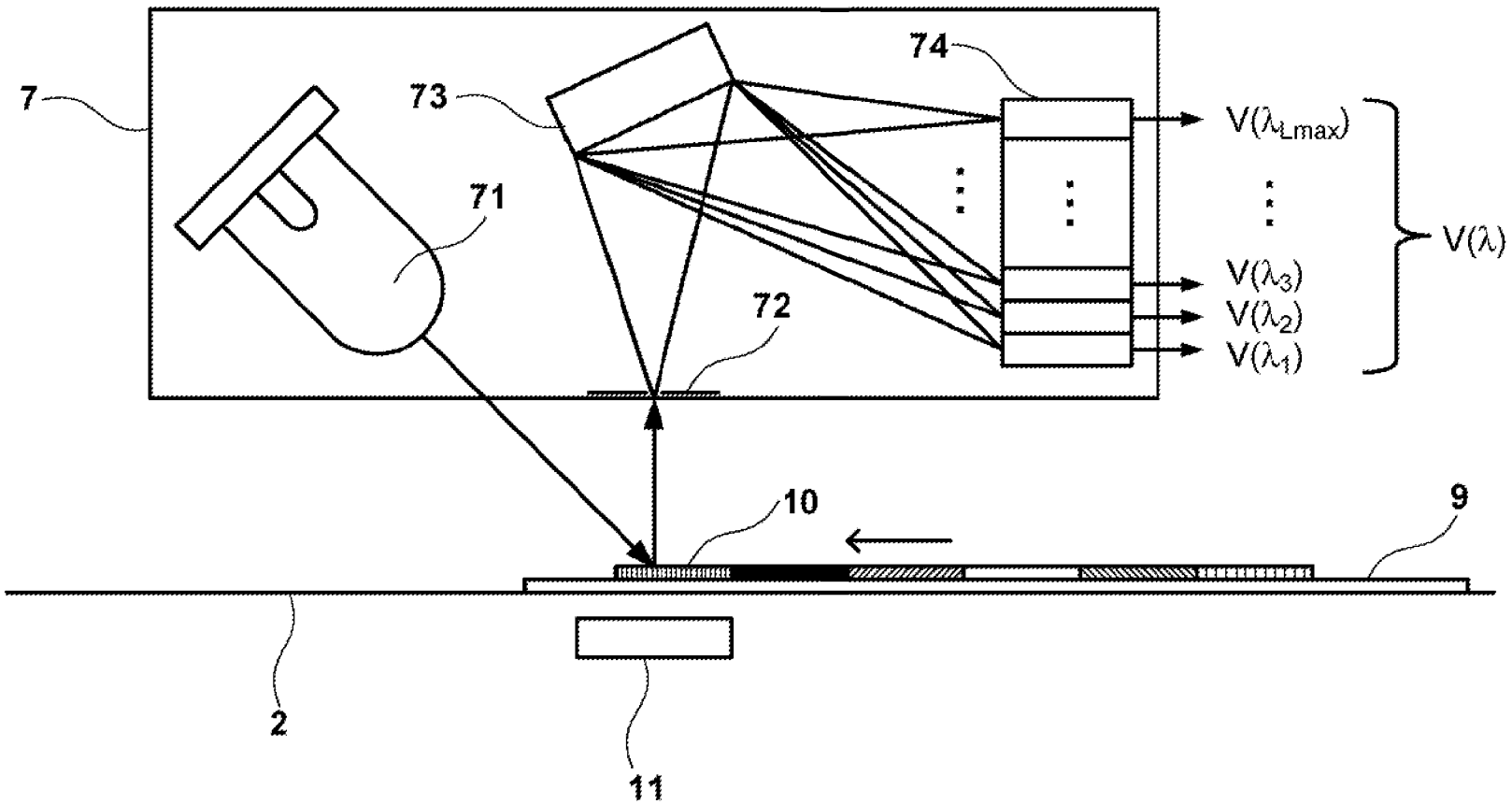
FIG. 2 is a block diagram of a color sensor of an embodiment.

The color sensor 7 is, for example, a spectroscopic color sensor (spectral distribution detection unit) capable of measuring light intensities at a plurality of wavelengths, for example, at 100 or more wavelengths. For example, as shown in FIG. 2, a white LED 71 of the color sensor 7 causes light to enter the recording material 9 on which a fixed patch image 10 has been formed at an angle of 45 degrees. A slit 72 allows light that is reflected by the patch image and reaches the slit 72 from a direction orthogonal to the surface of the recording material 9 to pass therethrough. A diffraction grating 73 separates light that has been reflected by the patch image and has passed through the slit 72 according to the wavelength. A line sensor 74 having a plurality of light-receiving units detects the intensity of light at each wavelength separated by the diffraction grating 73. When the detection range is from $\lambda_1$ (nm) to $\lambda_{Lmax}$ (nm), where $L_{max}$ indicates the total number of light-receiving units, and the light intensity at a wavelength $\chi$ is $V(\chi)$, the spectral distribution is expressed as $V(\lambda)$ ($\lambda=\lambda_1$, $\lambda_2$, . . . , and $\lambda_{Lmax}$). Note that a white reference plate 11 as a white reference portion is provided on the opposite side of the color sensor 7 with respect to the detection position.

Figure 3:
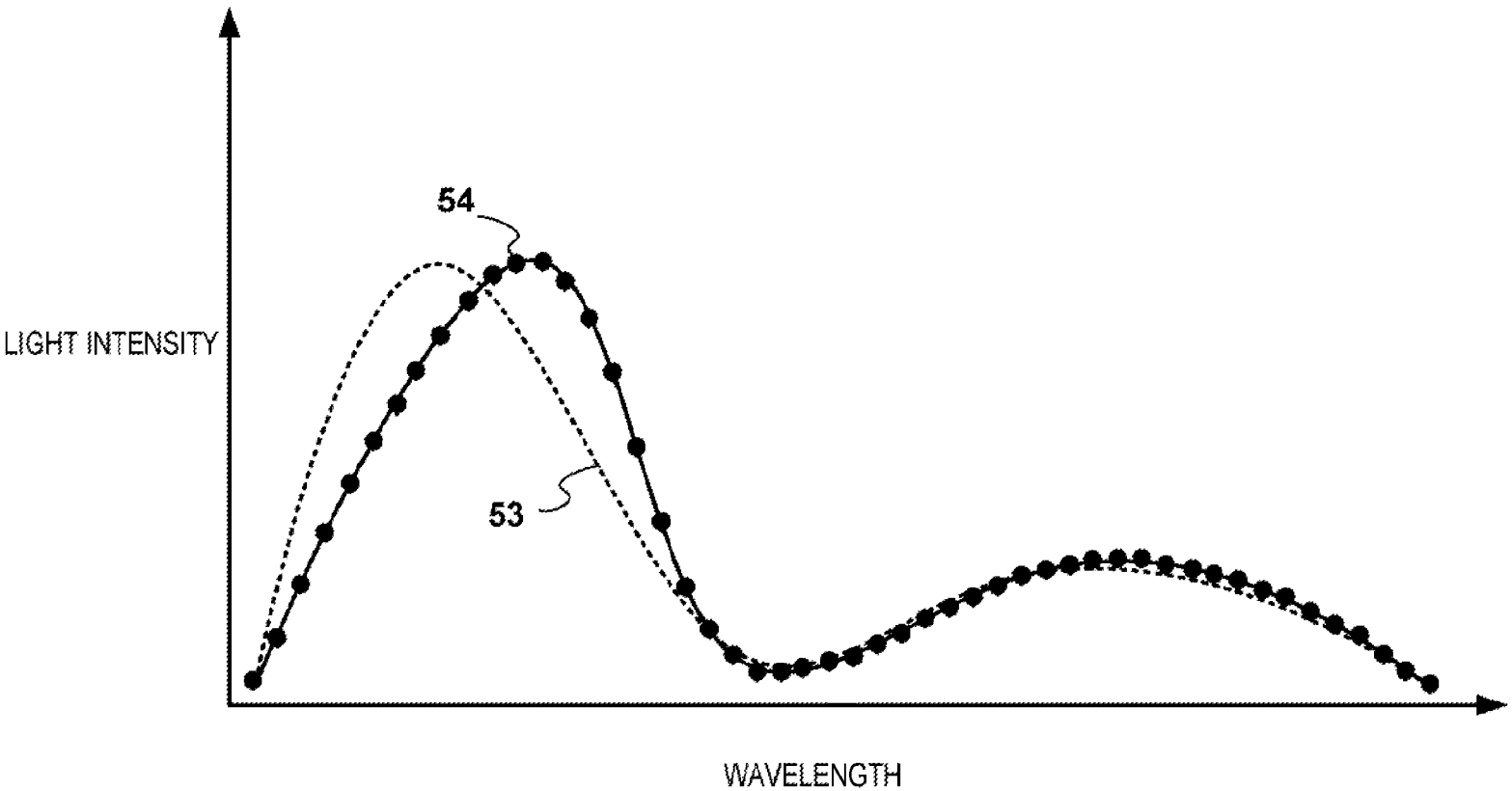
FIG. 3 is a diagram illustrating the intensity at various wavelengths detected by the color sensor of an embodiment.
Figure 16:
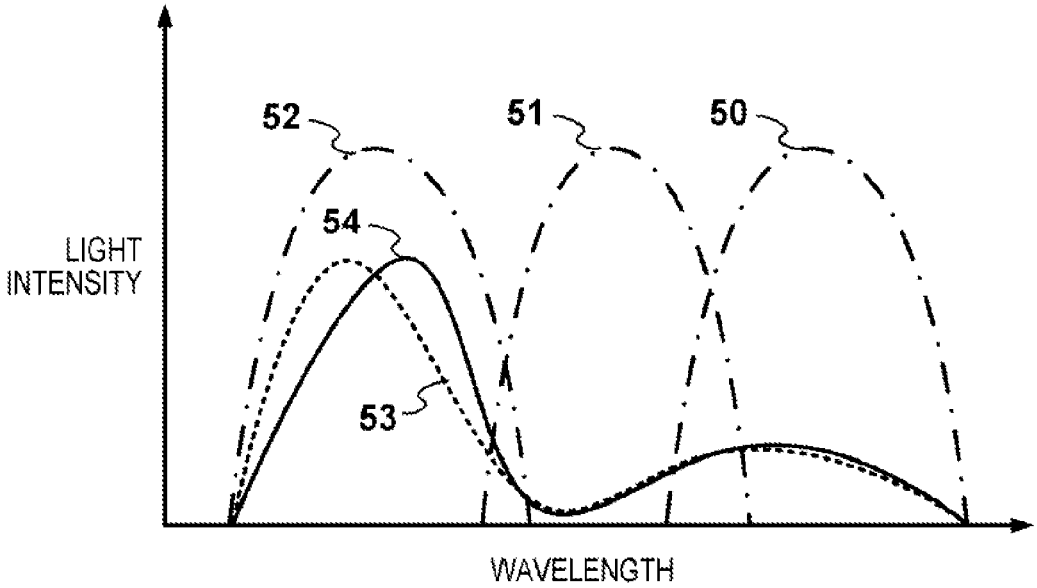
FIG. 16 is a diagram illustrating patch images, light reflected by the patch images having substantially the same RGB values.

FIG. 3 illustrates a state in which light intensity at each wavelength has been measured by the color sensor 7 with respect to a patch image 54 in FIG. 16. Note that the positions indicated by black circles in FIG. 3 represent wavelength positions at which light intensity has been detected. It is understood from FIG. 3 that even if patch images giving substantially the same RGB values are adjacent to each other, it is possible to recognize the boundary therebetween and determine whether or not the patch image being detected has changed, by acquiring a light intensity at each wavelength with respect to the patch image 53 as well and comparing the light intensity with that of the patch image 54. On the other hand, if the light intensities at all the wavelengths detected by the color sensor 7 are used to identify the patch image, an enormous amount of processing will be required and time is required for the identification. In addition, the circuit size increases, which causes an increase in cost. In the present embodiment, as described below, the patch image that is currently being detected is identified based on a wavelength for identification instead of using the light intensities at all wavelengths. In this manner, the arithmetic operation load is reduced, thereby increasing the processing speed.

Figure 4:
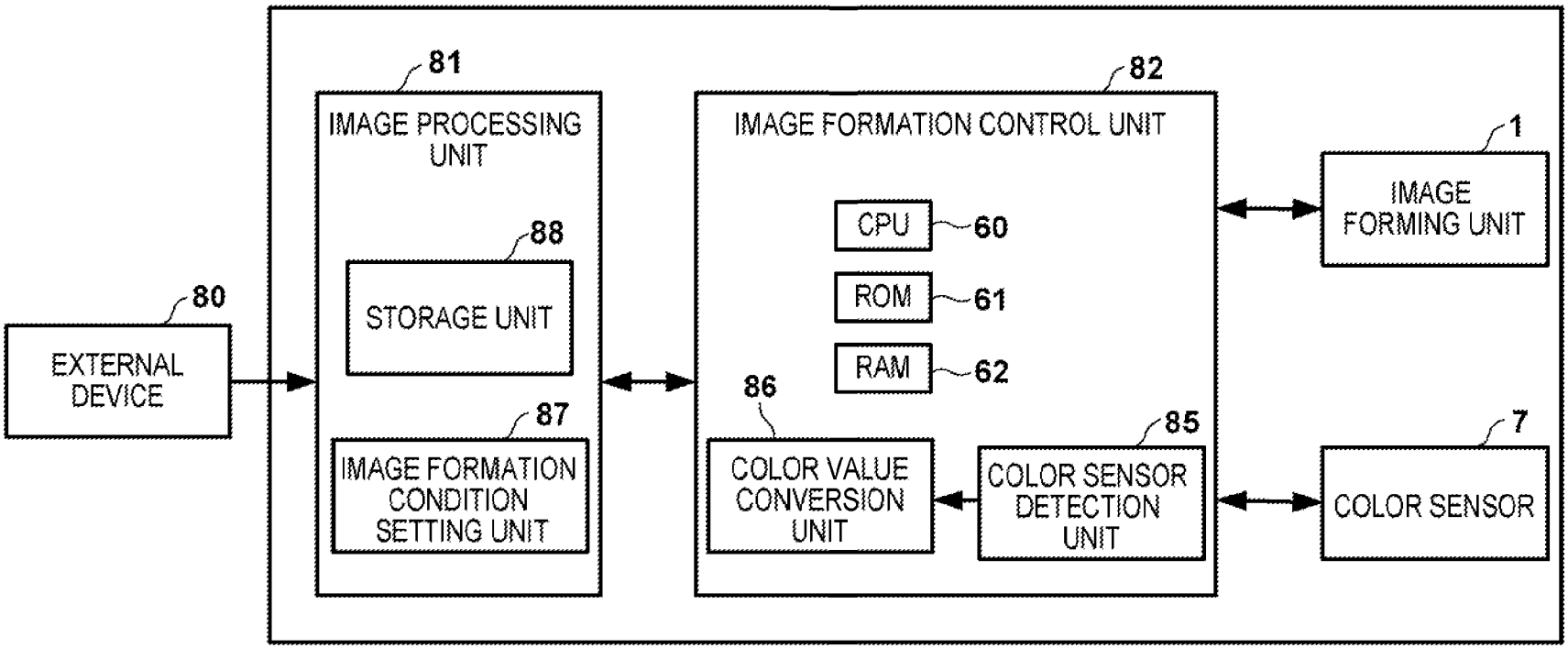
FIG. 4 is a block diagram of an image forming apparatus of an embodiment.

Next, operations of the image forming apparatus of the present embodiment will be described with reference to FIG. 4. The image forming apparatus receives an image signal (RGB signal) from an external device 80 such as a personal computer. An image processing unit 81 converts the received RGB signal to a CMYK signal. Note that when converting an RGB signal to a CMYK signal, for example, a 3D look-up table is used. The image processing unit 81 then corrects the density and tone characteristics of the generated CMYK signal using a correction table, and generates an image signal to be supplied to the exposure unit 32 in FIG. 1.

An image formation control unit 82 performs overall control of the image forming unit 1. Note that a ROM 61 of the image formation control unit 82 saves therein programs executed by a CPU 60, and a RAM 62 is for storing therein a variety of types of data when the CPU 60 performs control processing. Note that when the correction table is prepared or updated, a color sensor detection unit 85 receives, from the color sensor 7, the light intensity at each wavelength of each patch image, and a color value conversion unit 86 converts the received light intensity at each wavelength to a color value.

Figure 5:
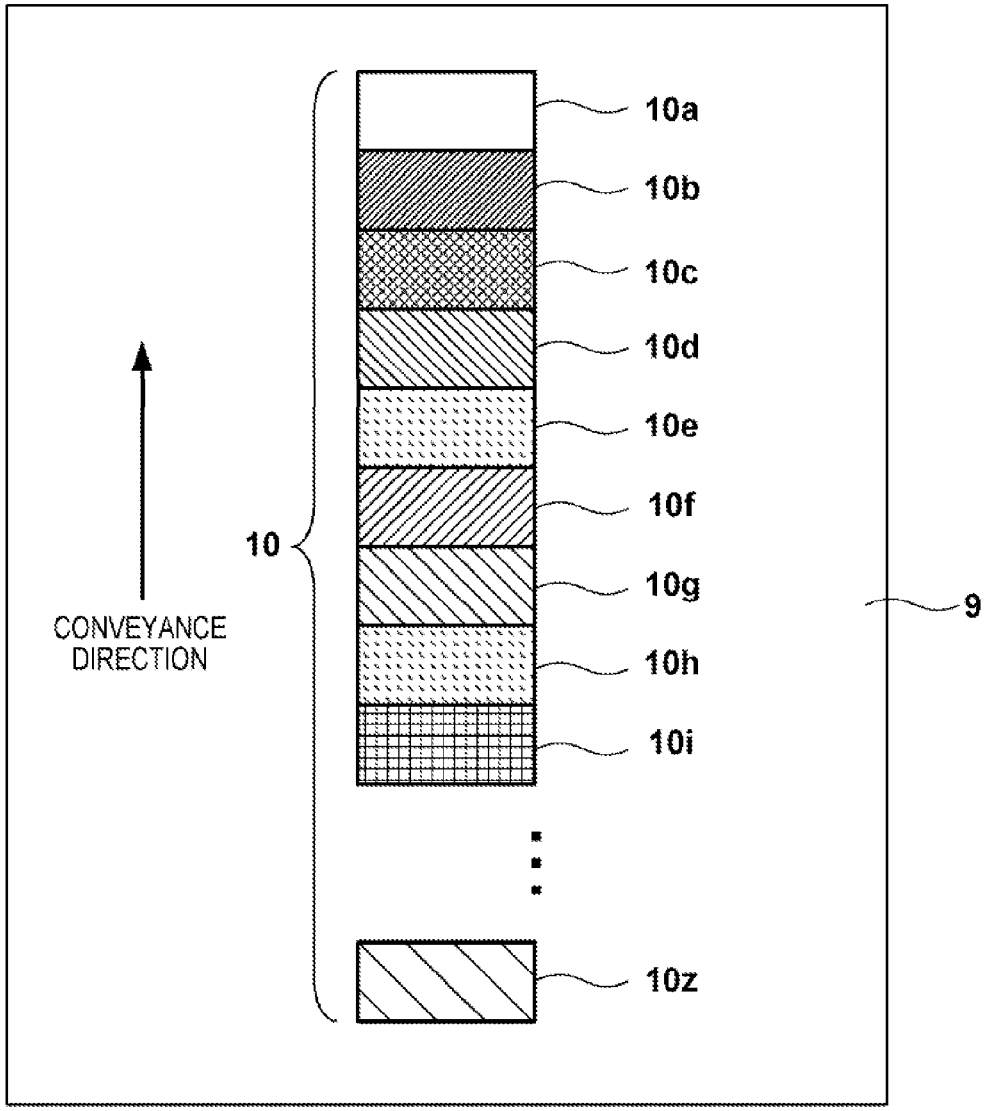
FIG. 5 is a diagram illustrating patch images of an embodiment.

As shown in FIG. 5, the patch image 10 formed on the recording material 9 includes a plurality of types of patch images such as patch images 10*a*, 10*b*, . . . , and 10*z*. Data representing these patch images is stored in a storage unit 88 of the image processing unit 81. Note that a plurality of images of the patch image 10 are arranged in the conveyance direction of the recording material 9 while providing no interval therebetween. A patch image is formed using toner of a single color such as cyan, magenta, yellow, or black, or is formed using toners of two or more colors (mixed-color patch image). The image formation control unit 82 detects the light intensity at each wavelength of the patch image 10 with the color sensor 7, and converts the result of this detection to a color value in, for example, the CIE-L*a*b* color system. Note that the method for calculating a color value in the CIE-L*a*b* color system and the like based on the spectral distribution is well known, and thus a detailed description thereof is not given here.

An image formation condition setting unit 87 sets an image formation condition by calculating correction data such that the converted color value is a reference color value saved in the storage unit 88. Here, the image formation condition may be the 3D look-up table described above. Also, for example, a table for converting a CMYK signal generated from an RGB signal to a C'M'Y'K' signal may be used as the image formation condition. It becomes possible to form a toner image having good tint and density by performing correction control based on the correction data calculated as described above. The image formation condition is set, for example, during activation of the image forming apparatus or during a pause in ordinary print processing. Note that setting of the image formation condition may be automatically started under preset conditions, or may be started upon input of an explicit instruction given by a user.

Figure 6:
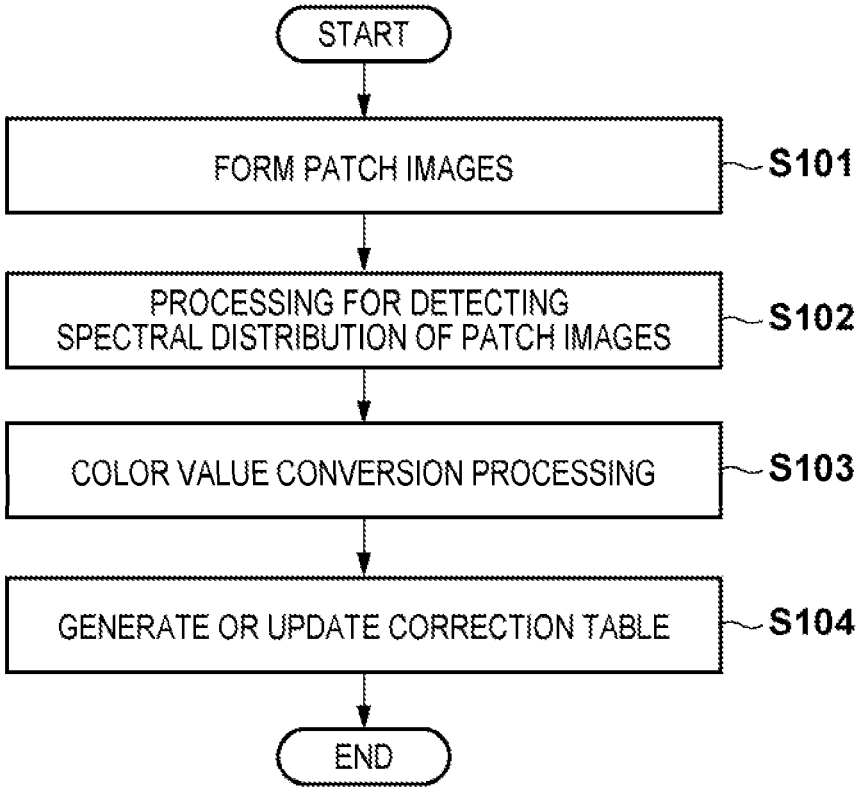
FIG. 6 is a flowchart of processing for setting an image formation condition of an embodiment.

Next, processing for setting the image formation condition of the present embodiment will be described with reference to FIG. 6. In step S101, the CPU 60 controls the image forming unit 1 based on the image data of the patch image 10 saved in the storage unit 88 of the image processing unit 81, thereby forming a plurality of patch images in succession on the recording material 9.

In step S102, the color sensor detection unit 85, upon instruction from the CPU 60, activates the color sensor 7 prior to the leading end of the patch image 10 reaching the detection position 2*a*, and performs processing for detecting the spectral distributions of all of the patch images. Here, "detect the spectral distribution" means that the color sensor 7 measures light intensities at a plurality of wavelengths. Note that details of the processing performed in step S102 will be described later. In step S103, the color value conversion unit 86 converts, upon instruction from the CPU 60, the detected spectral distribution of each patch image to a color value in, for example, the CIE-L*a*b* color system.

In step S104, the image formation condition setting unit 87 updates the image formation condition such that if the color value conversion unit 86 performs conversion to a color value next time a toner image is formed, the converted color value matches the reference color value saved in the storage unit 88 of the image processing unit 81. Here, as described above, the image formation condition refers to, for example, various coefficients of a calculation formula for obtaining CMYK values from RGB values, and the image formation condition setting unit 87 updates, for example, a 3D look-up table. An image having desired color values can be formed by converting RGB values to CMYK values according to the updated 3D look-up table.

Figure 7:
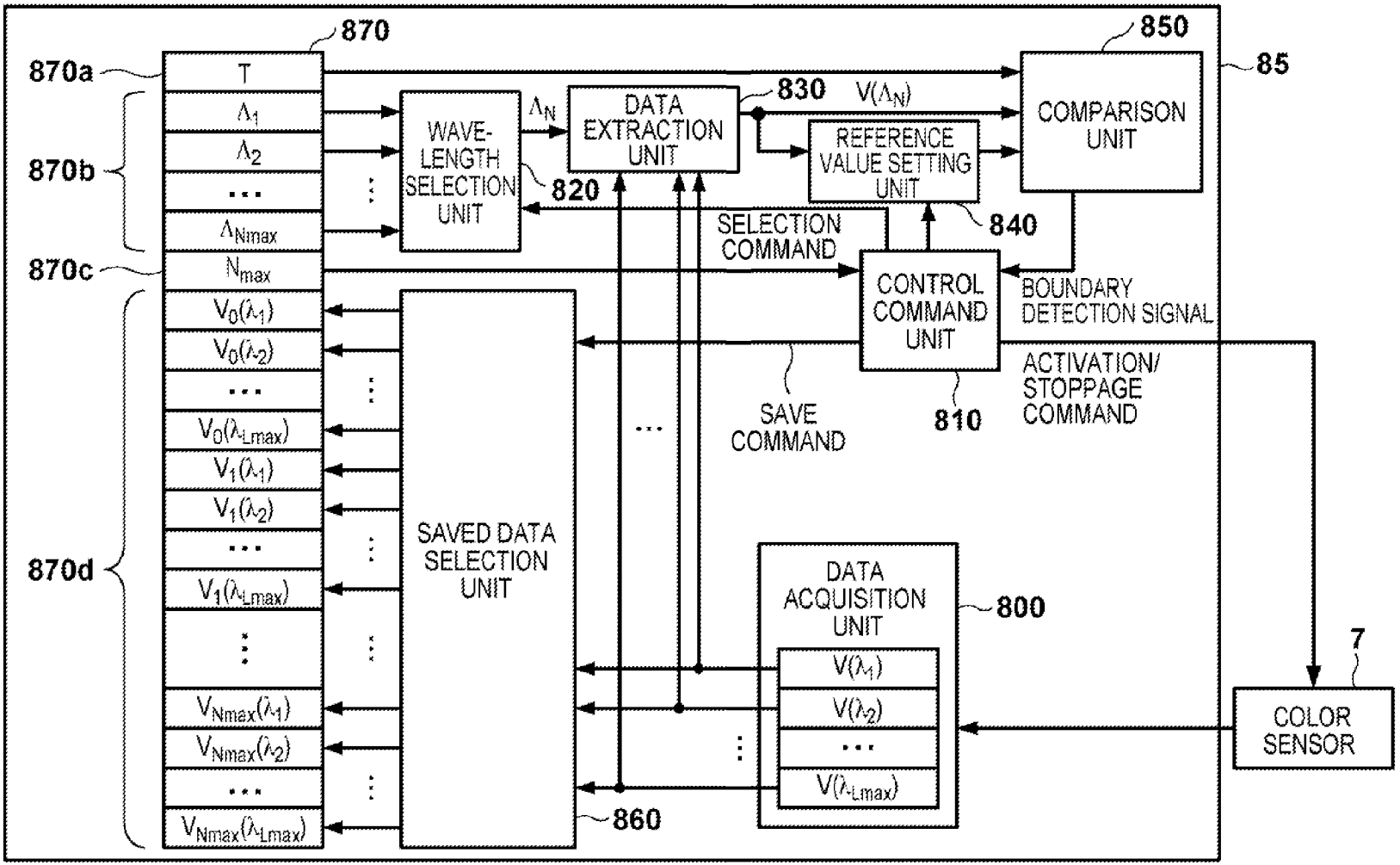
FIG. 7 is a block diagram of a color sensor detection unit of an embodiment.

Next, the color sensor detection unit 85 of the present embodiment will be described in detail with reference to FIG. 7. A control command unit 810 performs overall control of the color sensor detection unit 85. Note that for the purpose of simplicity, not all the control lines and data lines between elements are shown in FIG. 7. A data acquisition unit 800 acquires the spectral distribution, namely, a light intensity $V(\lambda)$ at each wavelength $\lambda$ ($\lambda=\lambda_1$, - - - , and $\lambda_{Lmax}$) detected by the color sensor 7. Note that activation and stoppage of the color sensor 7 is controlled by the control command unit 810. A data saving unit 870 saves therein data representing a threshold 870*a* (first threshold), wavelengths for identification 870*b* that correspond to each of the patch images and that are for identifying each patch image, a total number of patch images 870*c*, and spectral distributions 870*d* of patch images. A wavelength selection unit 820, a data extraction unit 830, a reference value setting unit 840, and a comparison unit 850 constitute a patch image determination unit, which performs a series of processing regarding identification or determination of the patch image being detected by the color sensor 7. If the comparison unit 850 has detected that the patch image that is being detected by the color sensor 7 has changed, it sends a boundary detection signal to the control command unit 810. A saved data selection unit 860 selects whether or not to save the spectral distribution acquired by the data acquisition unit 800 in the data saving unit 870. Specifically, the control command unit 810 issues a save command to the saved data selection unit 860 upon receipt of the boundary detection signal, and in response to this, the saved data selection unit 860 saves the spectral distribution of a single patch image in the data saving unit 870.

Figure 8:
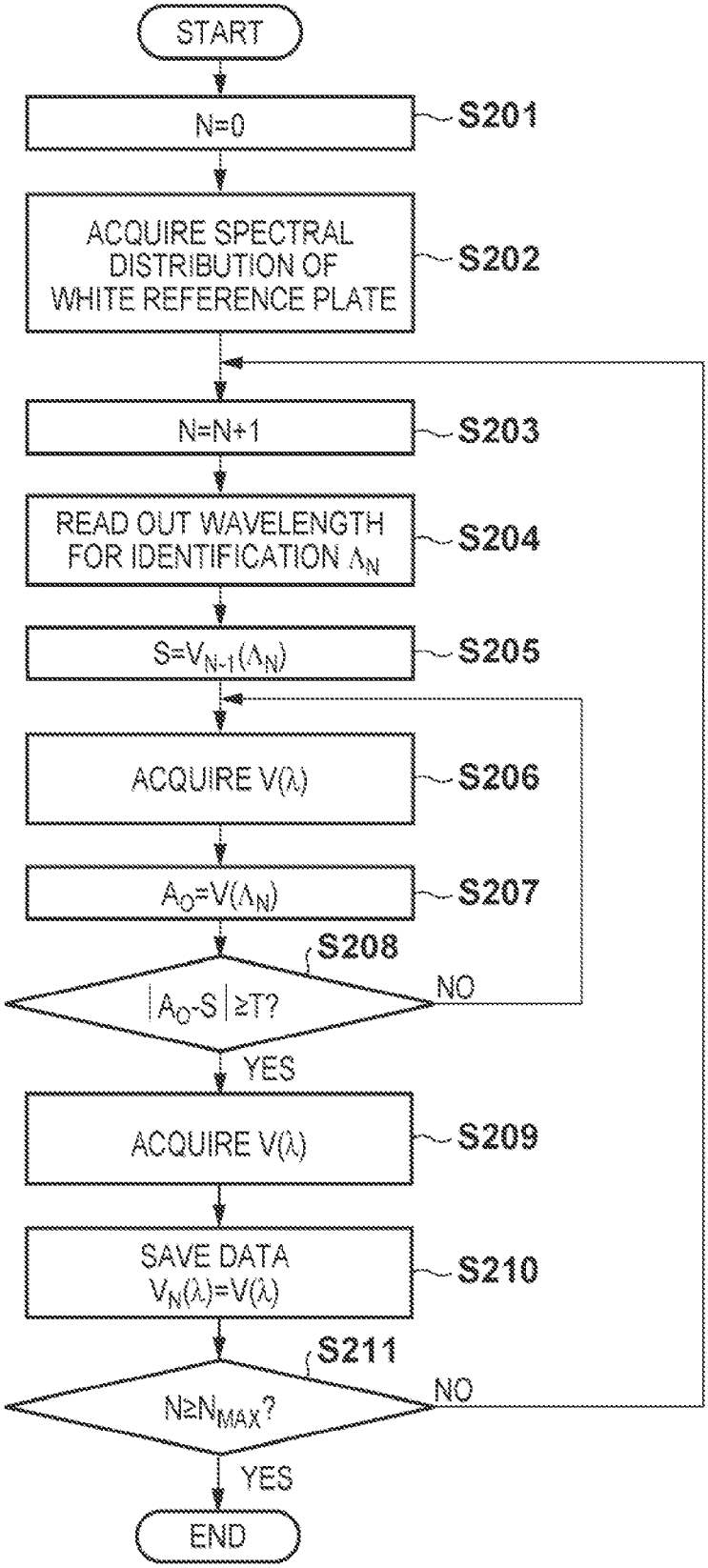
FIG. 8 is a flowchart of processing for detecting spectral distribution of an embodiment.

Next, processing for detecting spectral distribution of patch image performed in step S102 in FIG. 6 will be described in detail with reference to FIG. 8. Note that the detection processing is executed upon instruction from the CPU 60 by the elements of the color sensor detection unit 85 under the control of the control command unit 810.

In step S201, the control command unit 810 resets a counter N that indicates the patch image number to "0". Here, the counter N takes a value ranging from 0 to Nmax, which is the total number of the patch images. Note that when N=0, the spectral distribution of the white reference plate 11 is acquired, and when N=1 to Nmax, the spectral distribution of a patch image of the number corresponding to the counter value is acquired.

In step S202, the data acquisition unit 800 acquires spectral distribution $V_0(\lambda)$ of the white reference plate, and the saved data selection unit 860 saves the spectral distribution $V_0(\lambda)$ of the white reference plate in the data saving unit 870. In step S203, the control command unit 810 increments the counter N by one, and in step S204, notifies the wavelength selection unit 820 of the counter N, thereby issuing a selection command. Upon receipt of the selection command, the wavelength selection unit 820 reads out a wavelength $\Lambda_N$ corresponding to the counter N, namely, the Nth patch image, from among the wavelengths for identification 870*b* in the data saving unit 870, and notifies the wavelength $\Lambda_N$ to the data extraction unit 830. Note that a wavelength $\Lambda_1$ is used for judging that the first patch image is started, and a wavelength $\Lambda_2$ is used for judging that the boundary between the first and second patch images has been passed. A wavelength $\Lambda_{Nmax}$ is used for judging that the boundary between the last patch image and the patch image immediately preceding thereto has been passed.

In step S205, the data extraction unit 830 sets the light intensity $S=V_{N-1}(\Lambda_N)$ at the wavelength for identification read out in step S204 in the spectral distribution of the (N−1) th patch image, namely, the immediately preceding patch image, in the reference value setting unit 840. Note that the 0th patch image (when N=1) corresponds to the white reference plate 11.

In step S206, the data acquisition unit 800 acquires spectral distribution $V(\lambda)$ from the color sensor 7. In step S207, the data extraction unit 830 acquires, from the spectral distribution acquired by the data acquisition unit 800, light intensity $A_0=V(\Lambda_N)$ at the wavelength for identification read out in step S204, and outputs it to the comparison unit 850.

In step S208, the comparison unit 850 judges whether or not the absolute value of the difference between the light intensity $A_0$ and the light intensity S is greater than or equal to the threshold 870*a* (value T) saved in the data saving unit 870. In this manner, it is determined whether the patch image being detected by the color sensor 7 has transitioned from a first patch image that has been detected first to a second patch image to be detected next. Specifically, if the absolute value of the difference is greater than or equal to the threshold T, the comparison unit 850 judges that the boundary between the (N−1)th patch image and the Nth patch image has been already passed and that the color sensor 7 is detecting the Nth patch image, and outputs a boundary detection signal to the control command unit 810. In contrast, if the absolute value of the difference is less than the threshold T, the comparison unit 850 judges that the color sensor 7 is still detecting the (N−1)th patch image. If the absolute value of the difference is less than the threshold T, the processing returns to step S206, and the processing from steps S206 to S208 is repeated at a sampling time that is sufficiently short (e.g., 2 msec.), until the absolute value of the difference becomes greater than or equal to the threshold T.

If the absolute value of the difference is greater than or equal to the threshold T, in step S209, the data acquisition unit 800 acquires spectral distribution $V(\lambda)$ from the color sensor 7. Note that the spectral distribution V(λ) acquired in step S206 may be used, and in this case, step S209 is omitted. In step S210, the control command unit 810 issues a save command to the saved data selection unit 860. Upon receipt of the save command, the saved data selection unit 860 saves the spectral distribution V(λ) from the data acquisition unit 800 in the data saving unit 870 as the spectral distribution $V_N(\lambda)$ of the Nth patch image. In step S211, the control command unit 810 judges whether or not all the patch images have been detected, and if all the patch images have not been detected yet, the above-described processing is repeated until all the patch images are detected.

Next, a method for deciding the wavelengths for identification 870*b* in the data saving unit 870 will be described. The wavelengths for identification 870*b* are decided in advance as design values of the image forming apparatus, and saved in the data saving unit 870.

Figure 9A:
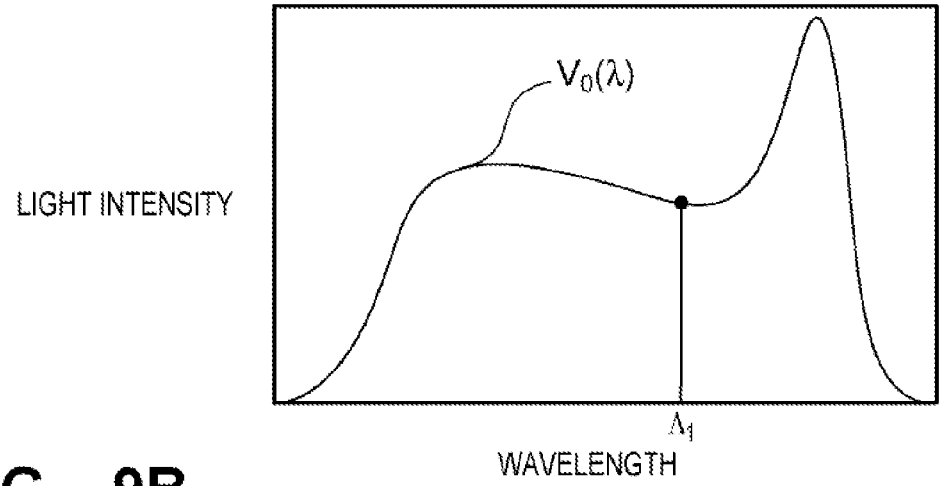
FIGS. 9A to 9C are diagrams illustrating how to decide a wavelength for identification of an embodiment.
Figure 9B:
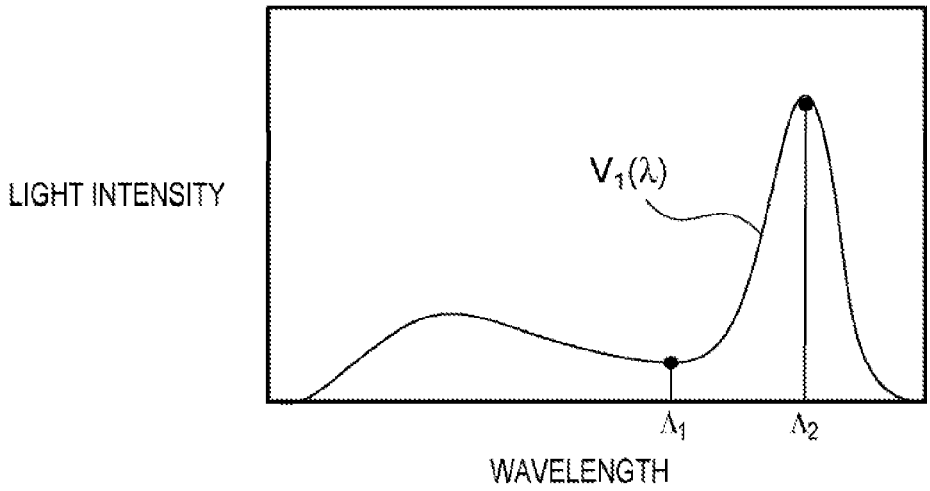
Figure 9C:
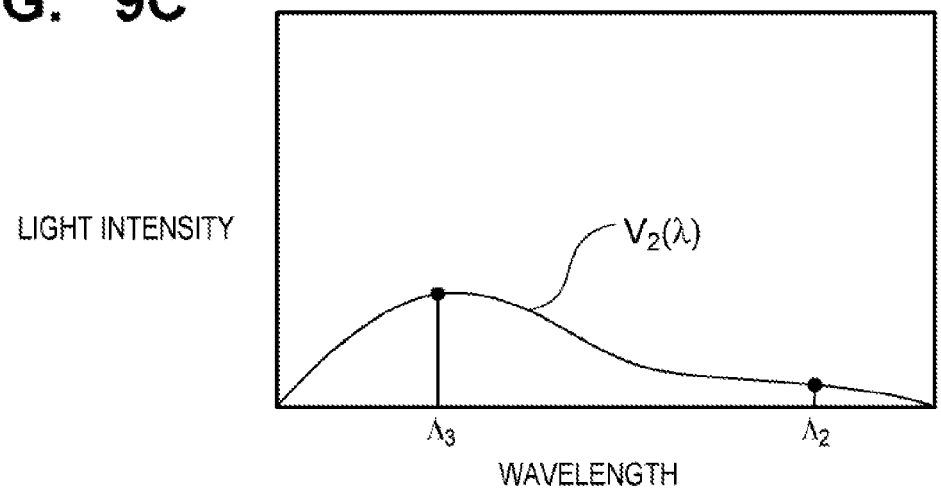

FIGS. 9A, 9B and 9C respectively illustrate the spectral distributions $V_0(\lambda)$, $V_1(\lambda)$, and $V_2(\lambda)$ of the white reference plate, the first patch image, and the second patch image. In the spectral distributions of the white reference plate and the first patch image, the difference in light intensity becomes largest at a wavelength $\Lambda_1$. Accordingly, it is the easiest way for detecting start of the first patch image to use the difference in light intensity at the wavelength $\Lambda_1$. Similarly, in the spectral distributions of the first patch image and the second patch image, the difference in light intensity becomes largest at a wavelength $\Lambda_2$. Accordingly, the difference in light intensity at the wavelength $\Lambda_2$ is used for detecting shift from the first patch image to the second patch image. The wavelengths $\Lambda_1$, $\Lambda_2$, . . . , and $\Lambda_{Nmax}$ decided in this manner are saved in the data saving unit 870 as the wavelengths for identification 870*b*.

As described above, in the present embodiment, it is judged that the boundary between patch images has been passed using a predetermined wavelength in order to recognize each patch image. In this manner, it becomes possible to detect the boundary between patch images that could not have been detected based on RGB values. In particular, in the present embodiment, it is not necessary to use all the wavelengths detected by the color sensor 7, and thus arithmetic operation load is reduced, so that the processing speed can be increased and the circuit size can be reduced.

Note that a configuration may be adopted in which each of the wavelengths for identification corresponding to the respective patch images may be selected from among wavelengths at each of which the difference in light intensity between patch images adjacent to each other is greater than or equal to a predetermined value. Also, a configuration may be adopted in which a plurality of wavelengths are selected from among a plurality of wavelengths acquired by the color sensor 7 to the extent that the processing load is not increased.

Second Embodiment

In the First Embodiment, the same threshold value T was used for the different patch image boundaries, although the difference in light intensity at a wavelength for identification, which is used to judge that a patch image boundary has been passed, differs from one boundary to another. Accordingly, it was necessary to set the threshold T to a value smaller than the value of the smallest difference in light intensity, among differences in light intensity at the wavelengths for identification with respect to each pair of adjacent patch images. In the present embodiment, different thresholds are used for different patch image boundaries.

Figure 10:
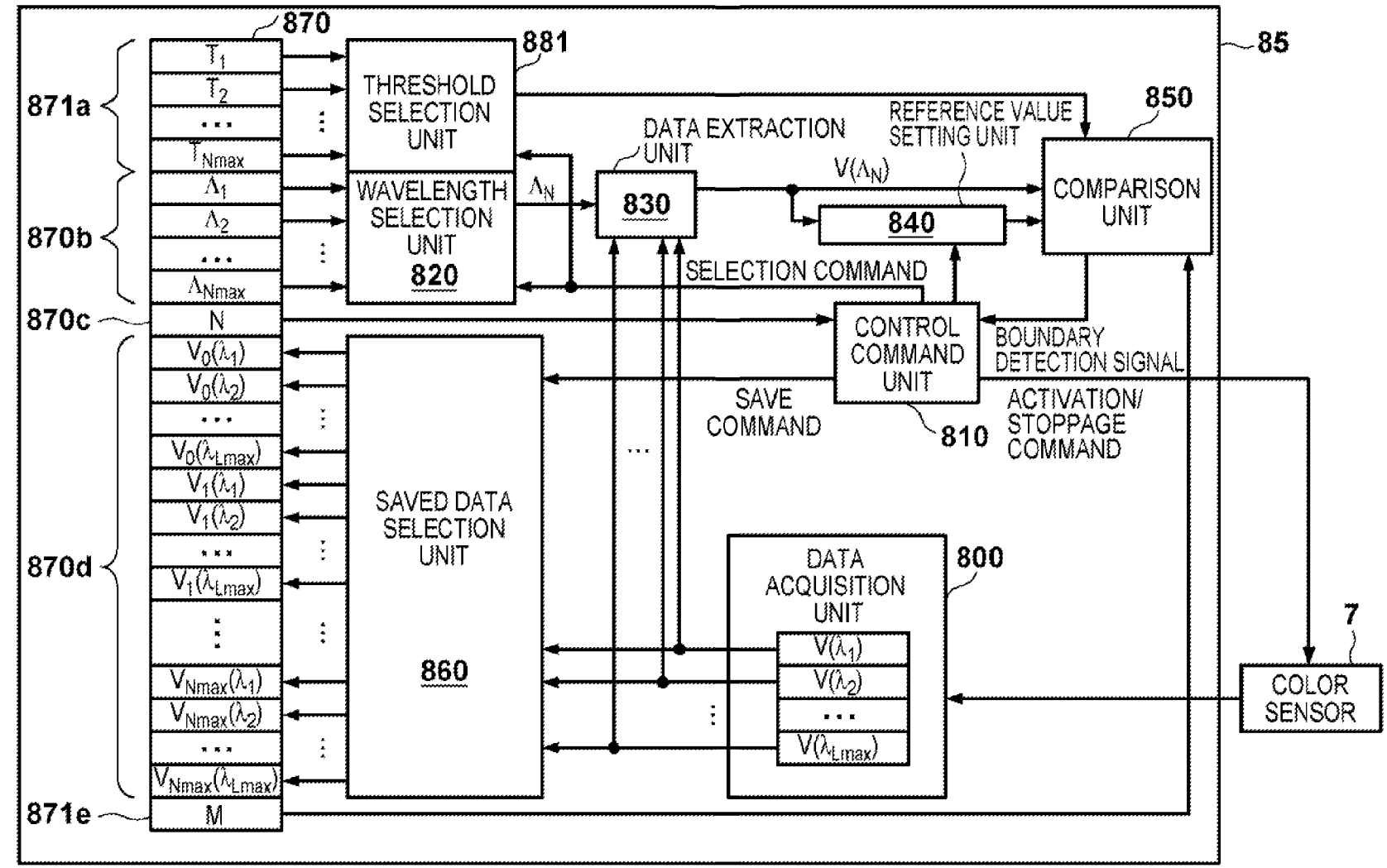
FIG. 10 is a block diagram of a color sensor detection unit of an embodiment.
Figure 11:
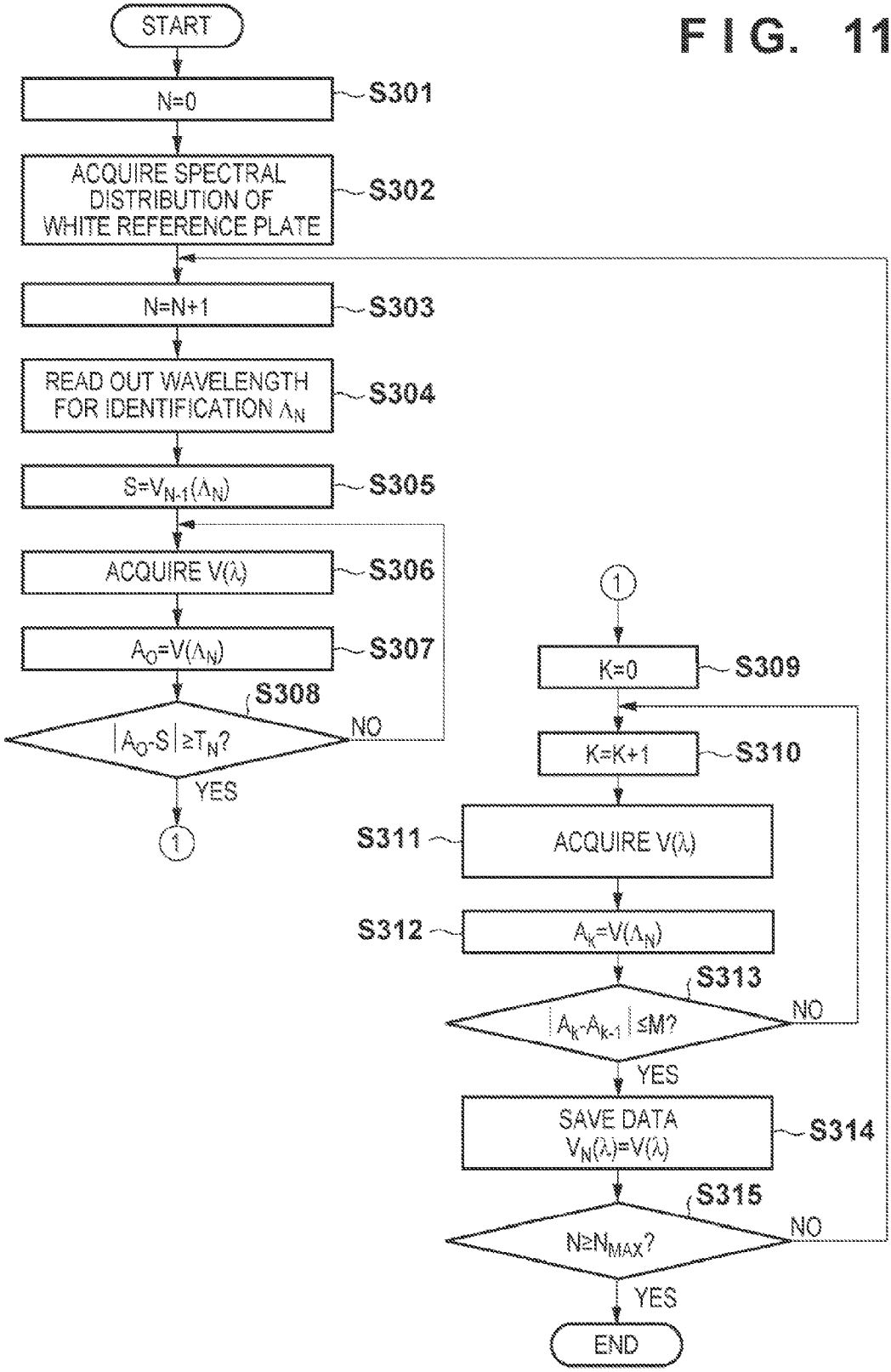
FIG. 11 is a flowchart of processing for detecting spectral distribution of an embodiment.

The present embodiment will be described below with reference to FIGS. 10 and 11. Note that in the block diagram of the color sensor detection unit 85 in FIG. 10, elements similar to those in First Embodiment are assigned the same reference numerals, and a detailed description thereof is omitted. As shown in FIG. 10, in the present embodiment, a threshold selection unit 881 is added to the configuration shown in FIG. 7. In addition, a threshold 871*a* (first threshold) is provided instead of the threshold 870*a*. The threshold 871*a* includes Nmax values, namely, $T_1$, $T_2$, . . . , and $T_{Nmax}$, respectively corresponding to the wavelengths for identification. Note the value $T_1$ is the threshold for detecting shift from the white reference plate to the first patch image, and the value $T_2$ is the threshold for detecting shift from the first patch image to the second patch image. Thereafter, in the same manner, $T_{Nmax}$ is the threshold for detecting transition to the last patch image. The threshold selection unit 881 selects a threshold 871*a* for each patch image to be identified. Also, in the present embodiment, the data saving unit 870 holds a threshold 871*e* (value M: third threshold) that is used for checking, when it is determined that the boundary between the patch images has been reached, whether the light spot from the color sensor 7 does not straddle the boundary between patch images.

Next, processing for detecting spectral distribution in the present embodiment will be described with reference to FIG. 11. Note that the processing in steps S301 to S307 is the same as that in steps S201 to S207 in FIG. 8, and thus a description thereof is omitted. In step S308, the comparison unit 850 judges whether or not an absolute value of the difference between the light intensity $A_0$ and the light intensity S is greater than or equal to the threshold $T_N$ saved in the data saving unit 870, and thereby judges whether the color sensor 7 is detecting the Nth patch image or the (N−1)th patch image. The threshold $T_N$ is set in accordance with a difference value at the wavelength $\Lambda_N$, at which the difference in light intensity between the Nth patch image and the (N−1)th patch image is large. That is, if the difference value at wavelength $\Lambda_N$ is large, $T_N$ is set to a large value, and if the difference value at wavelength $\Lambda_N$ is small, $T_N$ is set to a small value. Note that the threshold $T_N$ is a threshold for detecting shift from detection of the (N−1)th patch image to detection of the Nth patch image, and for example, is obtained in advance as half the value of the difference between $V_{N-1}(\Lambda_N)$ and $V_N(\Lambda_N)$. However, the threshold $T_N$ may be set to other values that are smaller than the difference between $V_{N-1}(\Lambda_N)$ and $V_N(\Lambda_N)$. If the absolute value of the difference is greater than or equal to the threshold $T_N$, the procedure proceeds to step S309, and if the absolute value of the difference is less than the threshold $T_N$, it is determined that the boundary between the patch images has not been reached, and the procedure returns to step S306, as in First Embodiment.

Processing in steps S309 to S313 is performed for improving detection accuracy by, after it is determined that the patch image being detected has shifted from the (N−1)th patch image to the Nth patch image (YES in step S308), additionally determining whether the light spot from the color sensor 7 is in the region of the Nth patch image.

First, in step S309, the control command unit 810 resets a counter k that indicates the number of times of detection to "0". In step S310, the control command unit 810 increments the counter k by one. In step S311, the data acquisition unit 800 acquires spectral distribution V(λ) from the color sensor 7, and in step S312, the data extraction unit 830 extracts, from the spectral distribution V(λ), light intensity $A_k=V(\Lambda_N)$ at a wavelength $\Lambda_N$, and outputs it to the comparison unit 850. In step S313, the comparison unit 850 compares $A_k$ with $A_{k-1}$. Note that $A_0$ is acquired by the comparison unit 850 in step S307. In the present embodiment, if the absolute value of the difference between $A_k$ and $A_{k-1}$ is less than or equal to the threshold M, it is determined that the light spot of the color sensor 7 is in the region of the Nth patch image. This is because when the light spot straddles the boundary between patch images, the light intensity in each measurement varies greatly. Note that the threshold M is decided by taking the amount of variation in each light intensity measurement that occurs in the same patch image into account. If the absolute value of the difference is greater than the threshold M, it is judged that the light spot straddles two patch images, and the procedure returns to step S310. In contrast, if the absolute value of the difference is less than or equal to the threshold M, it is determined that the light spot is in the region of the Nth patch image, and the procedure proceeds to step S314. In steps S314 and S315, processing corresponding to that in steps S210 and S211 in FIG. 8 is performed, and a description thereof is omitted.

Note that it is possible to improve identification accuracy compared with First Embodiment even by simply making the threshold variable in step S308. Accordingly, the procedure may move to step S314 after the comparison unit 850 has obtained the determination result YES in step S308. Also, identification accuracy of First Embodiment may be further improved by executing the processing in steps S309 to S313 between steps S208 and S209 in First Embodiment.

As described above, in the present embodiment, the threshold used for judging that the boundary between patch images has been passed is changed for each boundary between patch images. Therefore, it is possible to identify the patch image that is currently being detected with high accuracy. In addition, it is possible to accurately acquire spectral distribution of an intended patch image by judging whether the light spot is in the region of a patch image that is on the downstream side of two adjacent patch images.

Third Embodiment

In First and Second Embodiments, a wavelength for identification has been selected in advance corresponding to patch images adjacent to each other. Since the color sensor 7 detects spectral distribution while the recording material 9 is conveyed, detection errors may occur due to, for example, fluttering of the recording material 9. In addition, detection errors may occur due to variation in characteristics of the color sensor 7 or environmental changes as well. Depending on these detection errors and the combination of adjacent patch images, accuracy of patch image identification may be reduced.

In the present embodiment, a plurality of wavelengths are used as wavelengths for identification. The present embodiment will be described below with reference to FIGS. 12 and 13. Note that in the block diagram of the color sensor detection unit 85 shown in FIG. 12, elements similar to those in First Embodiment are assigned the same reference numerals, and a detailed description thereof is omitted. Note that in the present embodiment, as shown in FIG. 14, a color sensor 70 that includes a red LED 71R, a green LED 71G and a blue LED 71B is used instead of the white LED 71 in FIG. 2. The color sensor 70 emits light that has the emission spectrum for the entire visible light range and that has emission lines. By causing three LEDs to emit light at the same time, it is possible to obtain an emission spectrum equivalent to that of a white light source. Also, in the present embodiment, a wavelength decision unit 822 is provided instead of the wavelength selection unit 820 in FIG. 7. The wavelength decision unit 822 decides a plurality of wavelengths for identification 872*b* based on spectral distribution $V_0(\lambda)$ of the white reference plate, and saves them in the data saving unit 870. Also, the data saving unit 870 saves thresholds 872*a* corresponding to each of the wavelengths for identification 872*b*.

Figure 12:
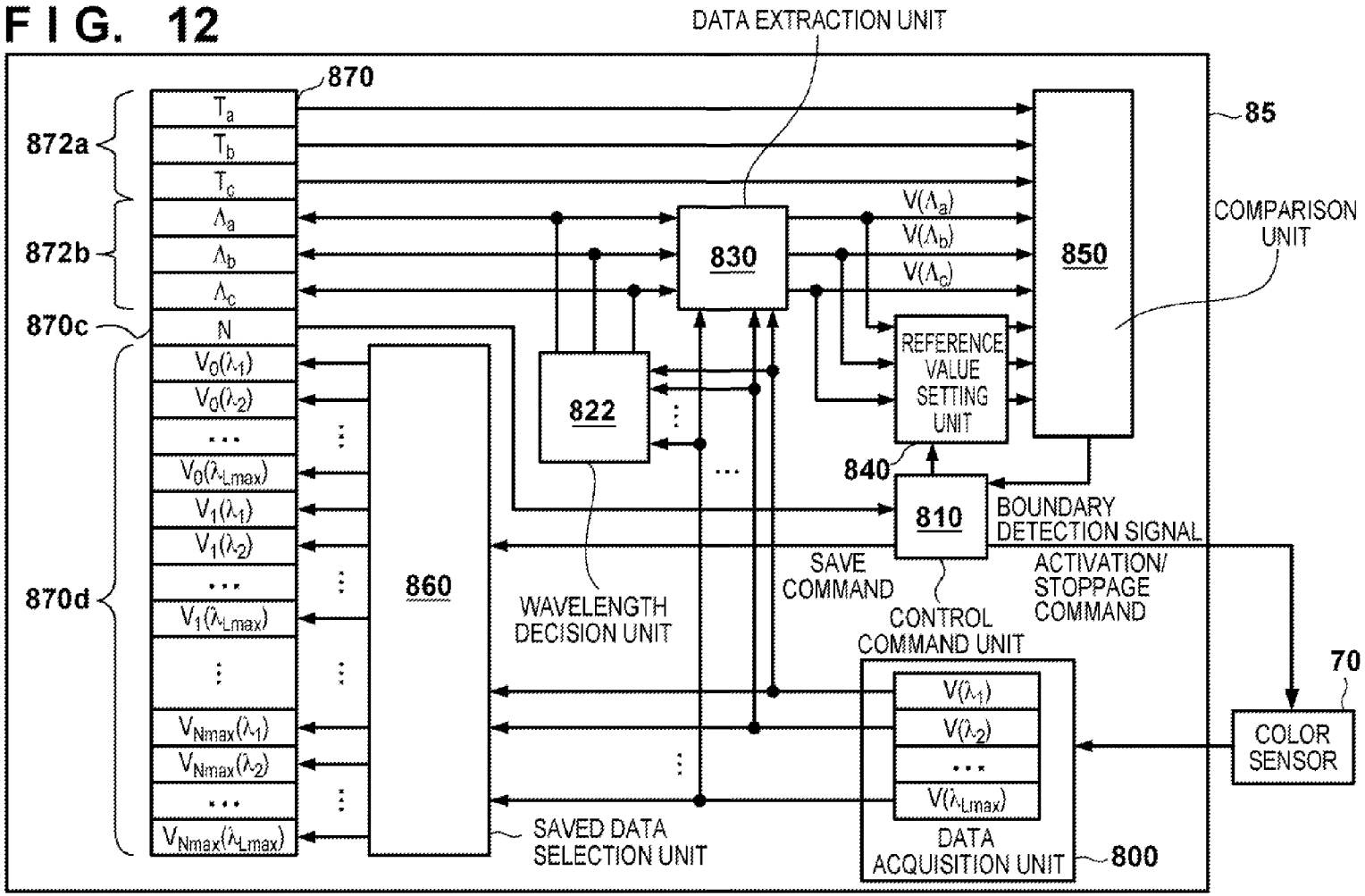
FIG. 12 is a block diagram of a color sensor detection unit of an embodiment.

Next, processing for detecting spectral distribution in the present embodiment will be described with reference to FIG. 13. The processing in steps S401 and S402 is the same as that in steps S201 and S202 in FIG. 8, and thus a description thereof is omitted. In step S403, the wavelength decision unit 822 selects, from the spectral distribution $V_0(\lambda)$ of the white reference plate, wavelengths that have a characteristic light intensity value, and saves the selected wavelengths in the data saving unit 870 as the wavelengths for identification 872*b*. As shown in FIG. 12, in the present embodiment, wavelengths $\Lambda_a$, $\Lambda_b$, and $\Lambda_c$ are assumed to be selected as the wavelengths for identification 872*b*. Note that the method for selecting the wavelengths for identification 872*b* will be described later.

In step S404, the control command unit 810 increments the counter N by one. In step S405, the data extraction unit 830 reads out the wavelengths for identification 872*b* from the data saving unit 870 upon instruction from the control command unit 810. In step S406, the data extraction unit 830 sets, in the reference value setting unit 840, light intensities $S_a=V_{N-1}(\Lambda_a)$, $S_b=V_{N-1}(\Lambda_b)$, $S_c=V_{N-1}(\Lambda_c)$ at the wavelengths for identification $\Lambda_a$, $\Lambda_b$ and $\Lambda_c$ in the spectral distribution of the (N−1)th patch image. Note that the 0th patch image (when N=1) corresponds to the white reference plate. In step S407, the data acquisition unit 800 acquires spectral distribution $V(\lambda)$ from the color sensor 7. In step S408, the data extraction unit 830 acquires light intensities $A_a=V(\Lambda_a)$, $A_b=V(\Lambda_b)$, $A_c=V(\Lambda_c)$ at the wavelengths for identification $\Lambda_a$, $\Lambda_b$, and $\Lambda_c$ from the spectral distribution acquired by the data acquisition unit 800, and outputs the light intensities to the comparison unit 850.

In step S409, the comparison unit 850 compares the difference in light intensity at each wavelength for identification with the corresponding threshold (first threshold). Specifically, it is judged whether or not the absolute value of the difference between the light intensity $A_a$ and the light intensity $S_a$ is greater than or equal to a threshold $T_a$, whether or not the absolute value of the difference between the light intensity $A_b$ and the light intensity $S_b$ is greater than or equal to a threshold $T_b$, and whether or not the absolute value of the difference between the light intensity $A_c$ and the light intensity $S_c$ is greater than or equal to a threshold $T_c$. In the present embodiment, if any of the absolute values of the difference is greater than or equal to the corresponding threshold, the comparison unit 850 determines that the Nth patch image has been reached, and the procedure proceeds to step S410. Otherwise, the comparison unit 850 determines that the boundary between patch images has not been reached, and the procedure returns to step S407. Note that steps S410 to S412 respectively correspond to steps S209 to S211 in FIG. 8, and thus a detailed description thereof is omitted.

Figure 15:
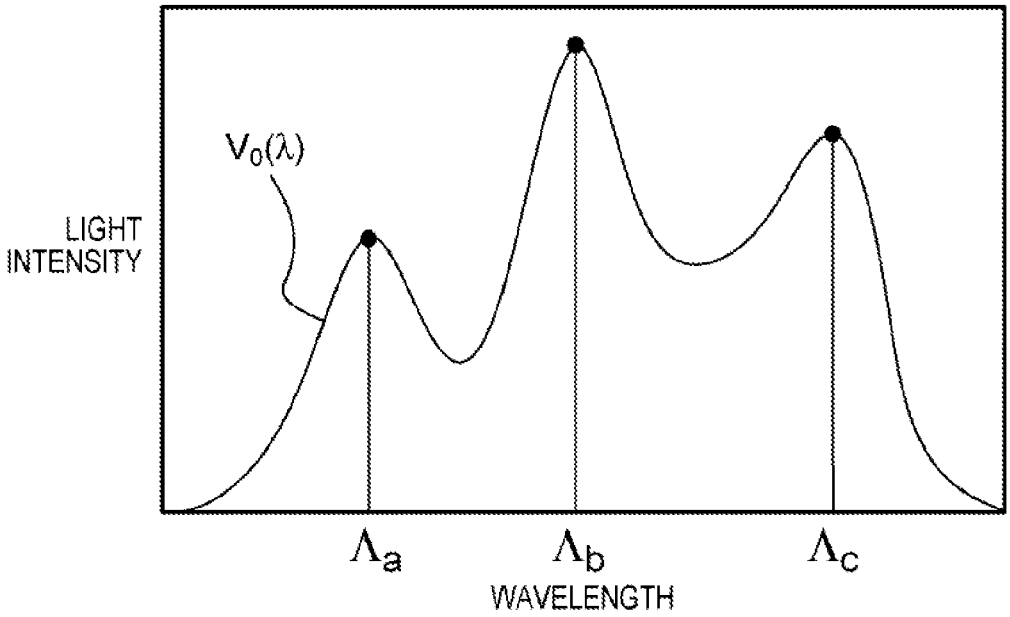
FIG. 15 is a diagram illustrating how to decide a wavelength for identification of an embodiment.

Next, calculation of the wavelengths for identification 872*b* by the wavelength decision unit 822 will be described. FIG. 15 illustrates an example of spectral distribution $V_0(\lambda)$ obtained when the white reference plate is irradiated with light using a light source having a predetermined spectrum (spectrum width). The predetermined spectrum has a plurality of peaks. In FIG. 15, the spectral distribution $V_0(\lambda)$ obtained when the white reference plate is irradiated with light using a light source having a predetermined spectrum has a total of three local maxima. In the spectral distribution obtained when the white reference plate is irradiated with light using a light source having a predetermined spectrum, the difference in light intensity of each patch image is relatively large at wavelengths corresponding to local maxima, and thus such wavelengths are useful for determining that the boundary between patch images has been passed. Accordingly, the wavelength decision unit 822 decides local maxima in the spectral distribution $V_0(\lambda)$ of the white reference plate as the wavelengths for identification 872*b* commonly used for different boundaries. Also, as long as a similar effect can be achieved, a wavelength corresponding to a substantial local maximum value may be used instead of a wavelength corresponding to a local maximum value in the spectral distribution obtained when the white reference plate is irradiated with light using a light source having a predetermined spectrum, and it is not necessarily required to use a local maximum value.

Note that the present embodiment may be combined with processing for judging whether or not the light spot straddles the boundary between patch images, similar to Second Embodiment. Also, although the wavelengths for identification 872*b* are selected from those corresponding to local maxima in the above description, the present embodiment is not limited thereto. For example, from among wavelengths at each of which the light intensity is greater than or equal to a predetermined value (second threshold) in the spectral distribution of the white reference plate, some wavelengths may be added to the wavelengths for identification 872*b* to the extent that processing load does not increase. Also, a configuration may be adopted in which the wavelengths for identification in First Embodiment and Second Embodiment are combined with the wavelengths for identification selected based on the spectral distribution of the white reference plate. Moreover, although the threshold 872*a* is set in the data saving unit 870 in advance in the present embodiment, a configuration may be adopted in which the control command unit 810, for example, decides the threshold 872*a* when the wavelength decision unit 822 has decided the wavelengths for identification.

Figure 13:
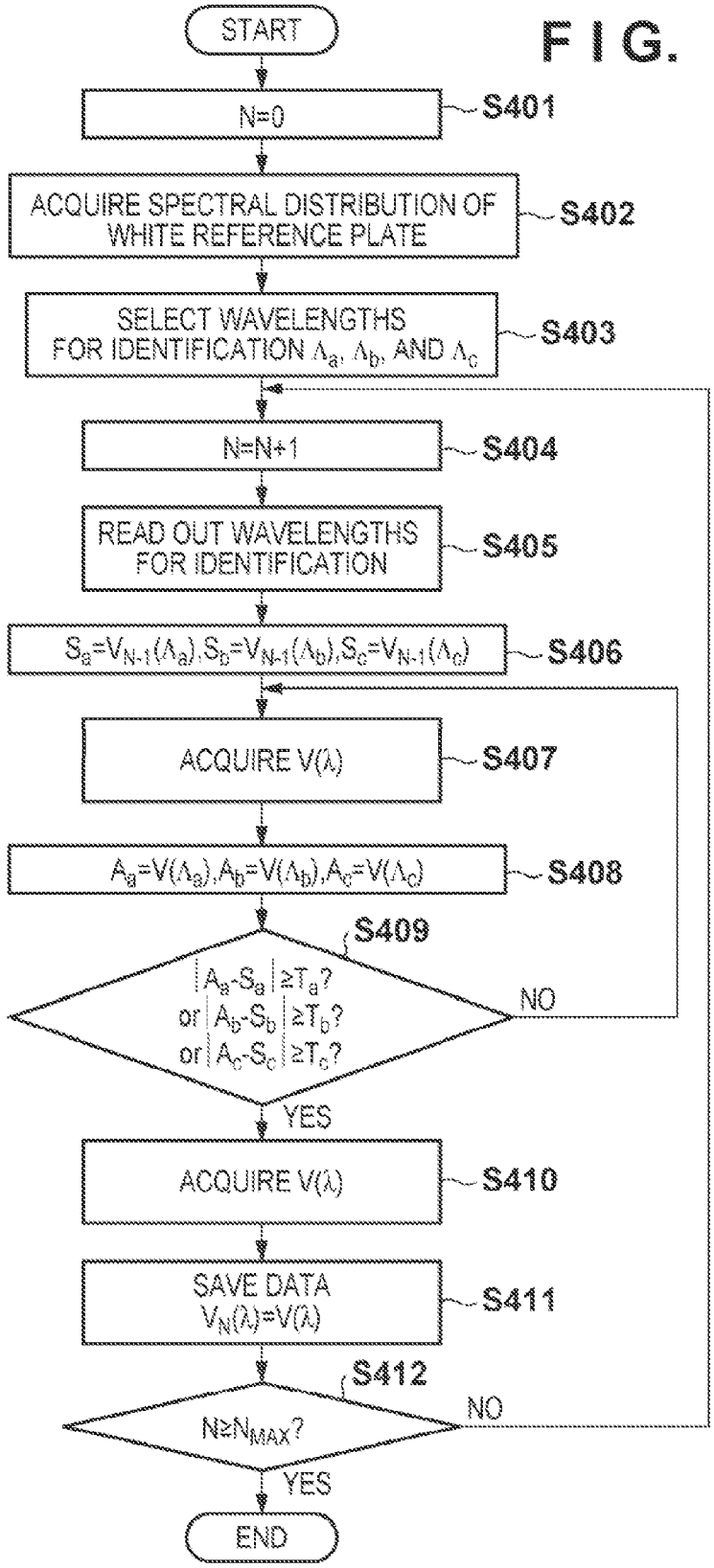
FIG. 13 is a flowchart of processing for detecting spectral distribution of an embodiment.
Figure 14:
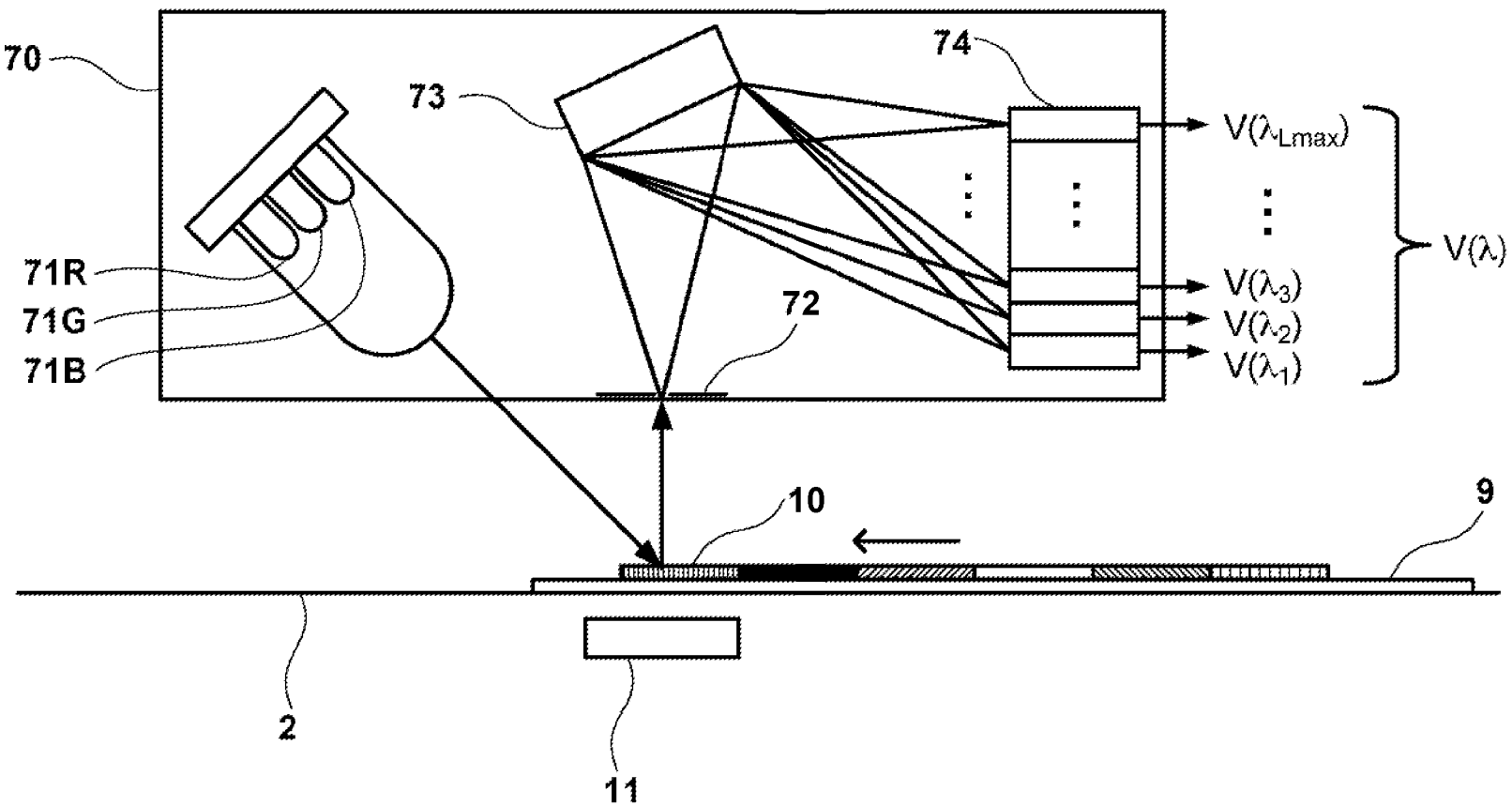
FIG. 14 is a block diagram of a color sensor of an embodiment.

Furthermore, in step S409 in FIG. 13, it may be determined that the next patch image is being detected, if the number of wavelengths for identification at which the absolute value of the difference is greater than or equal to the corresponding threshold is at least half of the total number thereof or a predetermined number (at least one). With these configurations, it is possible to reduce possibility of identification errors due to noise.

In addition, the color sensor 70 may include a light source that does not use three LEDs, namely, red, green and blue LEDs, as long as the light source has an emission spectrum for the entire visible light range. Furthermore, instead of providing the wavelength decision unit 822, design values calculated in advance may be saved in the data saving unit 870 as the wavelengths for identification 872*b* at the factory before shipment.

As described above, in the present embodiment, a patch image is identified based on a plurality of wavelengths for identification selected based on the spectral distribution of the white reference plate. In this manner, influence on such identification due to detection errors is reduced, and it is thereby possible to accurately identify the patch image and detect spectral distribution.

As described above, the image forming apparatus includes a determination unit that determines transition of the patch image whose light intensities are being detected by the color sensor 7 from the current patch image (first patch image) to the next patch image (second patch image). The determination unit determines that the patch image to be identified has been changed, if the light intensity, detected by the color sensor 7, at a wavelength for identification of the patch image to be identified has varied by an amount greater than the first threshold corresponding to that wavelength. By selecting a wavelength for identification suitable for patch images adjacent to each other, it is possible to determine that the patch image being detected by the color sensor 7 has changed, which has been impossible conventionally.

Note that a configuration may be adopted in which a plurality of wavelengths for identification are used, and for example, the patch image to be identified is identified if a light intensity has varied by an amount greater than the first threshold corresponding thereto at a predetermined number of wavelengths, such as identification based on the majority rule. With this configuration, influence of detection errors can be reduced.

In addition, it is possible to use a plurality of wavelengths as the wavelengths for identification commonly used for all boundaries, and these wavelengths are selected from among wavelengths at each of which the light intensity in the spectral distribution of the white reference plate is greater than or equal to the second threshold. With this configuration, influence of detection errors is reduced, and it is thereby possible to accurately identify the patch image and detect spectral distribution. Note that it is possible to easily select wavelengths for identification by, for example, choosing wavelengths at local maxima in the spectral distribution of the white reference plate. Note that only one wavelength may be used as the wavelength for identification for each patch image, and in this case, the processing load can be greatly reduced.

Also, after it is detected that the light intensity at a wavelength for identification has varied by an amount greater than the first threshold corresponding to the wavelength for identification, it is monitored whether the variation in the light intensity at the wavelength for identification is less than or equal to the third threshold. With this configuration, it is possible to detect that light spot for measuring light intensity straddles the boundary between patch images, and it is thereby possible to acquire spectral distribution of the patch image more reliably.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming unit configured to form a plurality of patch images in succession on a recording material;

a detection unit configured to irradiate a patch image formed on the recording material with light, and detect light intensities at a plurality of wavelengths in the light reflected from the patch image; and a determination unit configured to determine that a patch image for which the detection unit is detecting light intensities has transitioned from a first patch image to a second patch image in a case where a light intensity at a wavelength for identification, which is a detected wavelength among a plurality of wavelengths detected by the detection unit and which is used for determining a transition from the first patch image to the second patch image, has varied by an amount greater than a first threshold.

2. The image forming apparatus according to claim 1, wherein the wavelength for identification of each patch image includes a plurality of wavelengths, and the determination unit is further configured to determine that the patch image for which the detection unit is detecting light intensities has transitioned from a first patch image to a second patch image, in a case where a light intensity at each of a predetermined number of wavelengths among the plurality of wavelengths included in the wavelength for identification of the patch image to be identified, the light intensity being detected by the detection unit, has varied by an amount greater than the first threshold corresponding to the wavelength.

3. The image forming apparatus according to claim 1, wherein the wavelength for identification of each patch image includes a plurality of wavelengths, and the wavelengths are commonly used for the patch images, and the plurality of wavelengths are selected from among wavelengths at each of which a light intensity in spectral distribution obtained by irradiating a white reference portion with light using a light source having a predetermined spectrum is greater than or equal to a second threshold.

4. The image forming apparatus according to claim 3, wherein the plurality of wavelengths are selected from among wavelengths corresponding to a local maximum value or a substantial local maximum value in the spectral distribution of the white reference portion.

5. The image forming apparatus according to claim 1, wherein the wavelength for identification corresponding to each patch image includes a single wavelength.

6. The image forming apparatus according to claim 1, wherein the determination unit is further configured to determine that the patch image for which the detection unit is detecting light intensities has transitioned from the first patch image to the second patch image in a case where, after the light intensity at the wavelength has been detected for identification of the patch image to be identified, the light intensity being detected by the detection unit has varied by an amount greater than the first threshold corresponding to that wavelength for identification and it is detected that a variation in the light intensity at that wavelength for identification is less than or equal to a third threshold.

7. An image forming apparatus comprising:

an image forming unit configured to form a plurality of patch images in succession on a recording material;

a detection unit configured to irradiate a patch image formed on the recording material with light, and detect light intensities at a plurality of wavelengths in the light reflected from the patch image; and a determination unit configured to determine that a patch image for which the detection unit is detecting light intensities has transitioned from a first patch image to a second patch image in a case where a light intensity at a plurality of wavelengths for identification of a patch image to be identified, the light intensity being detected by the detection unit, has varied by an amount greater than a first threshold corresponding to those plurality of wavelengths for identification, wherein the plurality of wavelengths for identification are commonly used for the patch images, and the plurality of wavelengths are selected from among wavelengths at which a light intensity in spectral distribution obtained by irradiating a white reference portion with light using a light source having a predetermined spectrum is greater than or equal to a second threshold, and the plurality of wavelengths are selected from among wavelengths corresponding to a local maximum value or a substantial local maximum value in the spectral distribution of the white reference portion.

8. An image forming apparatus comprising:

an image forming unit configured to form a plurality of patch images in succession on a recording material;

a detection unit configured to irradiate a patch image formed on the recording material with light, and detect light intensities at a plurality of wavelengths in the light reflected from the patch image; and a determination unit configured to determine that a patch image for which the detection unit is detecting light intensities has transitioned from a first patch image to a second patch image in a case where, after the light intensity at the wavelength has been detected for identification of the patch image to be identified, the light intensity being detected by the detection unit has varied by an amount greater than a first threshold corresponding to that wavelength for identification and it is detected that a variation in the light intensity at that wavelength for identification is less than or equal to a second threshold.

9. The image forming apparatus according to claim 1, wherein the patch image is a single color patch image formed by cyan, magenta, yellow or black toner, or a mixed color patch image formed by two or more colors of toner.

10. The image forming apparatus according to claim 1, further comprising:

a fixing unit configured to fix an image formed on a paper that is the recording material, wherein the patch image is detected by the detection unit after fixing the patch image formed on the paper by the fixing unit and before discharging the paper from the image forming apparatus.

11. An image forming apparatus comprising:

an image forming unit configured to form a plurality of patch images in succession on a recording material, the plurality of patch images being used for detecting tint;

a spectral distribution detection unit configured to irradiate a patch image formed on the recording material with light, and disperse the light reflected from the patch image into a plurality of wavelengths; and a determination unit configured to determine that a patch image for which the spectral distribution detection unit is detecting is a first patch image or a second patch image among the plurality of patch images based on a intensity variation of a given wavelength among the plurality of wavelengths dispersed by the detection unit.

12. The image forming apparatus according to claim 11, wherein the patch image is a single color patch image formed by cyan, magenta, yellow or black toner, or a mixed color patch image formed by two or more colors of toner.

13. The image forming apparatus according to claim 11, further comprising:

a fixing unit configured to fix an image formed on a paper that is the recording material wherein the patch image is detected by the spectral distribution detection unit after fixing the patch image formed on the paper by the fixing unit and before discharging the paper from the image forming apparatus.

* * * * *